US009183773B2

(12) United States Patent
Twarecki et al.

(10) Patent No.: US 9,183,773 B2
(45) Date of Patent: Nov. 10, 2015

(54) METHOD AND APPARATUS FOR REPRESENTATION OF VIDEO AND AUDIO SIGNALS ON A LOW-RESOLUTION DISPLAY

(75) Inventors: Artur B. Twarecki, Toronto (CA); Mark Batchelor, Gormley (CA)

(73) Assignee: Imagine Communications Corp, Frisco, TX (US)

( * ) Notice: Subject to any disclaimer, the term of this patent is extended or adjusted under 35 U.S.C. 154(b) by 419 days.

(21) Appl. No.: 13/047,489

(22) Filed: Mar. 14, 2011

(65) Prior Publication Data

US 2011/0221957 A1 Sep. 15, 2011

Related U.S. Application Data

(63) Continuation of application No. 11/376,229, filed on Mar. 16, 2006, now abandoned, which is a continuation of application No. 10/210,101, filed on Aug. 2, 2002, now abandoned.

(30) Foreign Application Priority Data

Apr. 8, 2002 (CA) ..... 2380884

(51) Int. Cl.

| | |
|---|---|
| ***G09G 5/10*** | (2006.01) |
| ***G09G 3/20*** | (2006.01) |
| *G09G 3/00* | (2006.01) |

(52) U.S. Cl.

CPC ..... *G09G 3/2029* (2013.01); *G09G 3/001* (2013.01); *G09G 2320/0247* (2013.01); *G09G 2340/0407* (2013.01); *G09G 2340/145* (2013.01)

(58) Field of Classification Search

CPC .... G09G 5/227; G09G 5/391; G09G 2340/04

USPC ..... 345/204, 691, 698; 348/441

See application file for complete search history.

(56) References Cited

U.S. PATENT DOCUMENTS

| | | | |
|---|---|---|---|
| 4,665,494 | A | 5/1987 | Tanaka et al. |
| 4,679,085 | A | 7/1987 | Johnson et al. |

(Continued)

FOREIGN PATENT DOCUMENTS

| | | |
|---|---|---|
| CA | 1103822 | 6/1981 |
| CA | 2317790 | 3/2001 |

(Continued)

OTHER PUBLICATIONS

Veillette B R et al: "*High Frequency Sinusoidal Generation Usign Delta-Sigma Modulation Techniques*" 1995 IEEE International Symposium on Circuits and Systems (ISCAS), Seattle, Apr. 30-May 3, 1995, New York, IEEE, US, vol. vol. 1, Apr. 28, 1995, pp. 637-640, XP002272958 ISBN: 0-7803-2571-0.

(Continued)

*Primary Examiner* — Long D Pham

(74) *Attorney, Agent, or Firm* — Tarolli, Sundheim, Covell & Tummino LLP

(57) ABSTRACT

The method for the representation of video and audio signals on a low-resolution display panel, which includes the steps of: scaling the video or audio frame to fit the display panel, quantization of the video or audio signals to predetermined level values, temporal representation of video data by using the pulse density modulation, sending the signal pulses to the display panel. In further aspect the step of temporal representation contains the anti-flickering signal manipulation technique incorporating maximization of separation of the pulses during the pulse density modulation.

16 Claims, 2 Drawing Sheets

(56) References Cited

U.S. PATENT DOCUMENTS

| | | | | |
|---|---|---|---|---|
| 5,337,338 | A * | 8/1994 | Sutton et al. | 377/33 |
| 5,363,208 | A | 11/1994 | Ogino et al. | |
| 5,485,199 | A * | 1/1996 | Elkind et al. | 348/180 |
| 5,586,227 | A | 12/1996 | Kawana et al. | |
| 5,739,862 | A * | 4/1998 | Cen | 375/240.15 |
| 5,903,247 | A | 5/1999 | Howard et al. | |
| 6,023,553 | A * | 2/2000 | Boyce et al. | 386/329 |
| 6,041,295 | A | 3/2000 | Hinderks | |
| 6,052,146 | A * | 4/2000 | Webb et al. | 348/190 |
| 6,072,452 | A | 6/2000 | Worley, III et al. | |
| 6,091,777 | A * | 7/2000 | Guetz et al. | 375/240.11 |
| 6,198,467 | B1 | 3/2001 | Chiang | |
| 6,281,822 | B1 | 8/2001 | Park | |
| 6,489,936 | B1 | 12/2002 | Gormish | |
| 6,538,656 | B1 | 3/2003 | Cheung et al. | |
| 6,563,513 | B1 | 5/2003 | Yu et al. | |
| 6,597,371 | B2 | 7/2003 | Mandl | |
| 6,608,632 | B2 | 8/2003 | Daly et al. | |
| 6,628,720 | B1 | 9/2003 | Sekii | |
| 2001/0010509 | A1 | 8/2001 | Okuda | |
| 2001/0016010 | A1 | 8/2001 | Kim | |
| 2001/0028346 | A1 | 10/2001 | Kudo et al. | |
| 2002/0126752 | A1 * | 9/2002 | Kim | 375/240.03 |

FOREIGN PATENT DOCUMENTS

| | | | |
|---|---|---|---|
| JP | 09274476 | A | 10/1997 |
| JP | 411075081 | | 3/1999 |

OTHER PUBLICATIONS

Patent Abstracts of Japan vol. 1998, No. 02, Jan. 30, 1998 & JP 09 274476 A (NEC CORP), Oct. 21, 1997.

* cited by examiner

Fig. 1 Video and Audio Signals Reproducer
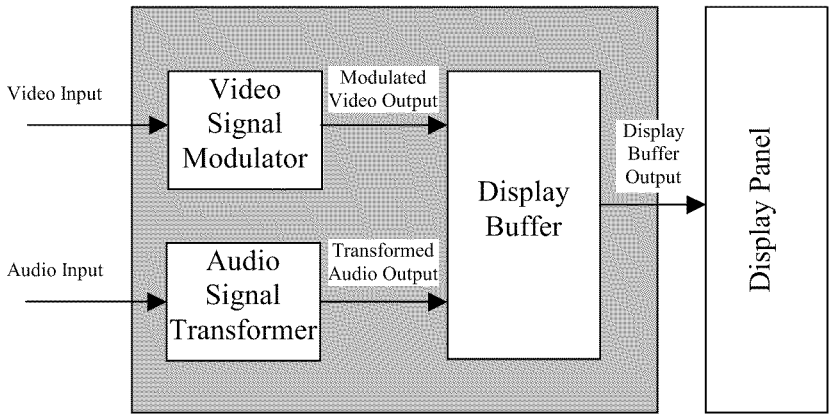
Fig. 2 Video Signal Modulator
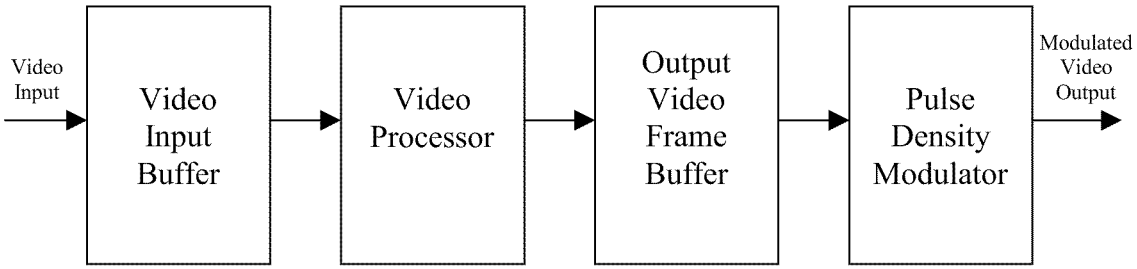

Fig. 3 Implementation of Pulse Density Modulation
*(a)* *Example of Direct Implementation*
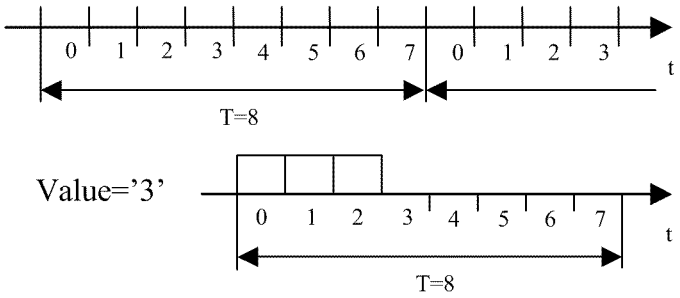
*(b)* *Example of Anti-flickering Implementation*
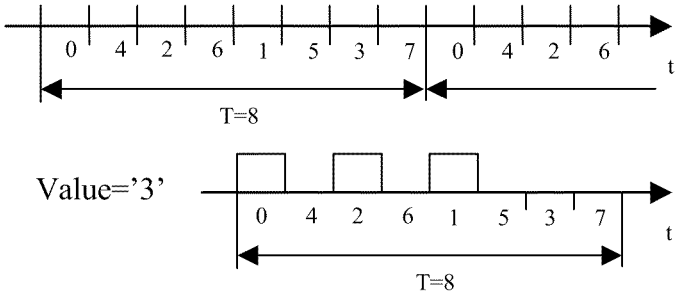
Fig. 4 Audio Signal Transformer
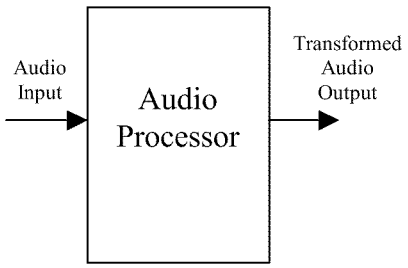

METHOD AND APPARATUS FOR REPRESENTATION OF VIDEO AND AUDIO SIGNALS ON A LOW-RESOLUTION DISPLAY

FIELD OF THE INVENTION

The present invention relates to the control systems of the physical display panels. More particularly, it relates to the reproduction of the video and audio signals on a display panel.

BACKGROUND OF THE INVENTION

The low-resolution display panels such as Vacuum Fluorescent Display, Light-Emitting Diode, Liquid Crystal Display and others are often used for visual representation of numeric data. The goal of current invention was to use the low-resolution displays for visual representation of gray-scaled video and audio signals. The main problem was how to reconcile the two-value states for each pixel on the low-resolution display (only 'on' or 'off') with requirements to represent the multiple-value gray-scaled data from video sources.

The current invention uses the so-called Pulse Density Modulation to represent gray-scaled video data on the low-resolution display. The property of Pulse Density Modulation is that it conveys the data values by asserting the variable number of pulses in each fixed period of time. This characteristic of Pulse Density Modulation is suitable to transmit the brightness value of each pixel due to the property of human eye to integrate binary (only 'on' or 'off') brightness pulses over the time to perceive them as the gray-scaled pixels.

The two-dimensional spatial Pulse Density Modulation was used in the prior art for halftoning image rendering systems for printing color and gray-scaled documents. The current invention uses temporal Pulse Density Modulation technique to represent changing-in-time signals.

SUMMARY OF THE INVENTION

It is an object of the present invention to provide a method and an apparatus for the reproduction of the video and audio signals on a low-resolution display panel.

Unlike prior art methods the method of invention represents the low-resolution frame buffer on a display panel by using the one-dimensional temporal pulse density modulation technique.

According to the method of the invention, the video or audio frames are scaled to fit the low-resolution display panel, signal values are quantized to the predetermined level values, these values are modulated in time using the pulse density modulation technique, and pulses are sent to the display panel.

In further development, for the video signals the quantized values are altered during modulation in the way that after modulation the biggest temporal distance separates each two consecutive pulses. This property allows avoiding an appearance of flickering on the display panel in most cases. To achieve the effect, the pulses' count is incremented starting from the most significant bit and going further to the least significant bit.

An apparatus implementing the proposed method includes the following parts: a Video Signal Modulator, an Audio Signal Transformer, and Display Buffer. The Video Signal Modulator consists of Input Video Buffer, Video Processor, Output Video Frame Buffer, and Pulse Density Modulator. The Audio Signal Transformer contains Audio Processor, Audio Frame Buffer, and Audio Signal Modulator. The Video Signal Modulator has also control logic to perform the anti-flickering processing of signal.

BRIEF DESCRIPTION OF THE DRAWINGS

FIG. 1 shows the Video and Audio Signals Reproducer.

FIG. 2 describes details of the Video Signal Modulator.

FIG. 3 clarifies the Pulse Density Modulation implementation.

FIG. 4 shows details of the Audio Signal Transformer.

DETAILED DESCRIPTION OF THE INVENTION

The invention is applicable to the reproduction of the video and audio signals on the low-resolution display panel.

FIG. 1 describes a Video and Audio Signals Reproducer. The Reproducer has 2 data inputs: Video Input and Audio Input and 1 data output: Display Buffer Output. It consists of following parts: Video Signal Modulator, Audio Signal Transformer, and Output Display Buffer. The Reproducer may also have several input and output control signals (not shown here).

FIG. 2 shows details of the Video Signal Modulator. It receives Video Input data and temporally stores data in the Video Input Buffer. The data are going to the Video Processor, which scales it down vertically and horizontally to fit the low-resolution display panel. The Video Input Buffer is required due to necessity to perform the vertical scaling.

The Video Processor may also quantize the video data to decrease number of bits representing the digital values. In a preferred embodiment, when the Video Input Data does not include the luma component, the Video Processor may perform a color space conversion to obtain data for display.

Output from the Video Processor is the scaled down quantized video data representing the luma component of the video signal. These data are arranged in the form of an Output Video Frame Buffer.

The current invention reconciles the multiple-value data from the Output Video Frame Buffer with the requirements for the binary data (only 'on' or 'off') inside Display Buffer, which drives the low-resolution Display Panel. Physically in some designs, such as Vacuum Fluorescent Display, the Display Buffer can be part of the Display Panel.

The invention uses the so-called Pulse Density Modulation to solve mentioned discrepancy. The Pulse Density Modulation conveys the numerical values by asserting the variable number of pulses in each fixed period of time. This property of Pulse Density Modulation is used to transmit the brightness value of each pixel due to the capacity of human eye to integrate binary ('on' or 'off') brightness pulses over the time to perceive them as the gray-scaled pixels.

FIG. 3 describes the Pulse Density Modulation implementation. As an example, it is shown the modulation of signals with eight possible distinct values. The period of Pulse Density Modulation is equal to eight to represent the signal values varying from 0 to 7. The set of one 'on' pulse and seven 'off' pulses represents the 'zero' value, and the set of eight consecutive 'on' pulses represents the highest 'seven' value. The set of eight consecutive 'off' pulses is not used in this example otherwise up to nine possible distinct values can be represented with the period equal to eight. The eight positive numbers varying from 0 to 7 can be easily expressed by three-bit values.

The FIG. 3 shows two possible implementations of aforementioned modulation. The first one is a direct implementation where three-bit count traditionally goes '000', '001', '010', '011', '100' and so on. This implementation creates an annoying visual artifact named "flickering". To decrease the flickering artifact the second implementation numbers the pulses unconventionally, starting from the most significant bit. Thus, for the eight-level values represented by three bits the count goes '000', '100', '010', '110', '001' and so on.

If signal values have 6 bits then the period of Pulse Density Modulation equal to 64 is used to represent the values. Therefore, in order to transmit the NTSC signal with a refresh rate 60 fields per second the Display Panel is refreshed with frequency 64×60=3840 frames per second or approximately 4 KHz.

FIG. 4 describes the Audio Signal Transformer. It receives Audio Input data, which are processed by an Audio Processor. The Audio Processor decimates the audio data samples, quantizes them, and possible transforms them into the logarithmic scale for the simplicity of perceiving. The transformed audio data samples are written as well into Display Buffer, which drives the low-resolution Display Panel. The Audio Processor may separates Audio Data into the left and the right channels, which then are shown on the Display Panel separately.

While a preferred embodiment of the present invention has been shown and described by way of example only, it will be apparent to those skilled in the art that changes and modifications may be made without departing from the scope of the invention, as set out in the appended claims.

We claim:

1. A method for modulation of a video signal for display on a low-resolution display, the method comprising:

scaling the video signal to fit the low-resolution display;

quantizing the video signal to predetermined level values;

generating a pulse density modulated representation of the scaled and quantized video signal;

altering the scaled and quantized video signal to result in an increased temporal distance between each two consecutive pulses in the pulse density modulated representation to decrease flickering; and sending the pulse density modulated representation of the scaled and quantized video signal directly to a display buffer for output of the pulse density modulated representation of the scaled and quantized video signal to the low-resolution display.

2. The method of claim 1, wherein the low-resolution display is a gray-scale display.

3. The method of claim 1, wherein the generating further comprises generating a binary number for each luma in the scaled and quantized video signal, wherein each binary number is generated by incrementing a most significant bit of the binary number before incrementing a least significant bit of the binary number to reduce flickering at the low-resolution display.

4. The method of claim 1 further comprising:

receiving an audio data signal;

decimating the audio data signal;

quantizing the audio data signal;

transforming the decimated and quantized audio data signal into a logarithmic scale; and sending the transformed audio data signal directly to the display buffer for output of the transformed audio data signal to the low-resolution display.

5. The method of claim 4, wherein the display buffer outputs one data signal to the low-resolution display, the data signal including the video signal representation and the transformed audio data signal.

6. The method of claim 4, further comprising displaying the video signal representation and the transformed audio data signal on the low-resolution display simultaneously.

7. The method of claim 1, wherein the pulse density modulated representation of the scaled and quantized video signal corresponds to brightness values of pixels of the low-resolution display for a given period of time.

8. The method of claim 7, wherein the brightness values for the pixels of the low-resolution display are set according to a number of pulses transmitted within the given period of time to the pixels as defined by the pulse density modulated representation of the scaled and quantized video signal.

9. The method of claim 8, wherein the pulse density modulated representation of the scaled and quantized video signal includes pulses distributed in the given time period to decrease flickering for each of the pixels of the low-resolution display.

10. The method of claim 1, further comprising adjusting each pixel of the low-resolution display to a corresponding brightness value based on the pulse density modulated representation of the scaled and quantized video signal to generate a gray-scaled version of the video signal on the low-resolution display.

11. A video signal modulator comprising:

a video processor configured to:

scale a video signal to fit a low-resolution display to generate a scale video signal; and quantize the scaled video signal to decrease the number of bits representing digital values of the scaled video signal to generate a scaled and quantized video signal; and a pulse density modulator configured to modulate the scaled and quantized video signal to generate a pulse density modulated video signal representation of the scaled and quantized video signal having an increased separation between consecutive pulses in the pulse density modulatedvideo signal to mitigate flickering;

an audieo signal transformer configured to transform and output a transformed audio data signal to the low-resolution display.

12. The video signal modulator of claim 11, wherein the low-resolution display is a gray-scale display.

13. A system comprising the video signal modulator of claim 11, the system further comprising:

a display buffer configured to:

receive and store the pulse density modulated video signal and the transformed audio data signal; and output the pulse density modulated video signal and the transformed audio data signal to the low-resolution display.

14. A video and audio signal reproducer, the reproducer comprising:

a video signal modulator configured to scale a video signal to fit a low-resolution display, quantize the video signal to predetermined level values and generate a pulse density modulated representation of the scaled and quantized video signal having an increased temporal distance between each two consecutive pulses in the pulse density modulated representation to mitigate flickering;

an audio signal transformer configured to transform a the decimated and quantized audio data signal into a logarithmic scale and generate a transformed audio signal;

a display buffer configured to:

receive and store the pulse density modulated video signal and the transformed audio signal; and output the pulse density modulated video signal representation and the transformed audio signal to the low-resolution display.

15. The reproducer of claim 14, wherein the audio signal transformer further comprises an audio processor configured to separate the transformed audio signal into left and right channel audio signals.

16. The reproducer of claim 15, wherein the left and right channel audio signals are displayed separately on the low-resolution display.

* * * * *

UNITED STATES PATENT AND TRADEMARK OFFICE

CERTIFICATE OF CORRECTION

PATENT NO. : 9,183,773 B2
APPLICATION NO. : 13/047489
DATED : November 10, 2015
INVENTOR(S) : Artur B. Twarecki et al.

It is certified that error appears in the above-identified patent and that said Letters Patent is hereby corrected as shown below:

In the claims

In column 4, line 37, claim 11 reads “audieo” should read --audio--

Signed and Sealed this
First Day of March, 2016

Michelle K. Lee

Michelle K. Lee
*Director of the United States Patent and Trademark Office*